United States Patent [19]

Fiedler

[11] 4,446,344

[45] May 1, 1984

[54] PRESSURE OPERATED SWITCH INCLUDING AN EXPANDABLE FLAT TUBE

[75] Inventor: Armin Fiedler, Chicago, Ill.

[73] Assignee: International Freezer Corp., Chicago, Ill.

[21] Appl. No.: 314,755

[22] Filed: Oct. 26, 1981

Related U.S. Application Data

[63] Continuation of Ser. No. 123,198, Feb. 21, 1980, abandoned.

[51] Int. Cl.[3] ..... H01H 35/34

[52] U.S. Cl. ..... 200/83 B; 200/81 R; 200/81.9 R; 92/92; 73/861.47

[58] Field of Search ..... 417/36–38, 417/43–45, 300; 73/861.47, 861.48, 861.53; 92/91, 92; 200/81.9 R, 81 R, 81.8, 83 R, 83 B, 83 S, 83 Y; 340/606, 611

[56] References Cited

U.S. PATENT DOCUMENTS

| | | | |
|---|---|---|---|
| 2,885,506 | 5/1959 | Anderson | 200/83 B |
| 3,423,551 | 1/1969 | Starbuck | 200/83 B |
| 3,424,883 | 1/1969 | Heskett | 200/81.9 R |
| 3,456,086 | 7/1969 | Asku | 200/81 R |
| 3,529,106 | 9/1970 | Little, Jr. | 200/83 B |
| 3,569,649 | 3/1971 | Spielbauer | 200/83 B |
| 3,636,289 | 1/1972 | Possell | 200/83 B |
| 3,827,828 | 8/1974 | Edwards | 200/83 B |
| 4,212,591 | 7/1980 | Lamontagne | 200/83 B |

FOREIGN PATENT DOCUMENTS

| | | | |
|---|---|---|---|
| 687706 | 8/1930 | France | 200/83 B |

*Primary Examiner*—G. P. Tolin

*Attorney, Agent, or Firm*—Mason, Kolehmainen, Rathburn & Wyss

[57] ABSTRACT

Apparatus and method are disclosed for actuating a desired device, such as a switch controlling a pump, in response to a predetermined pressure condition in a selected environment of varying pressure, such as closed vessel. A tube having a flattened segment of deformable material is disposed in fluid communication with the selected environment and a flattened segment of the tube is inserted between a tube support surface and a movable tube segment compression member. When the flattened tube segment expands in response to an increased pressure condition within the monitored environment, the tube segment compression member moves to actuate the device.

The flattened tube segment unexpectedly improves the precision and consistency in actuating the device exactly at the predetermined pressure condition.

10 Claims, 6 Drawing Figures

PRESSURE OPERATED SWITCH INCLUDING AN EXPANDABLE FLAT TUBE

BACKGROUND OF THE INVENTION

1. Field Of The Invention

The present invention is a continuation of Ser. No. 123,198, filed Feb. 21, 1980, now abandoned, and relates to a pressure operated device for providing an output signal in response to a predetermined pressure condition in a selected environment and, more particularly, the present invention relates to a pressure operated switch assembly for providing an output signal when a deformable flattened tube expands in response to pressure such that at a particular predetermined degree of expansion, a preexisting condition of a switch assembly is reversed from an on position to an off position or from an off position to an on position.

2. Prior Art

In many industrial processes it is desireable to have relatively automatic control of an electrical or mechanical device forming part of the apparatus used in the industrial process such that when a given vessel in that process reaches a predetermined pressure condition, the device is actuated. For example, in many industrial processes it is desireable to have a fluid holding tank or vessel maintained within a relatively narrow predetermined pressure range for controlled delivery of the fluid to another location in the process. Many times a pressure responsive probe switch or other device can be inserted directly within the vessel or within a process line connected to the vessel to be controlled. In some sanitary processes such as in the fine food industry, a pressure responsive device inserted directly within a vessel or in a vessel connected process conduit would contaminate the material and would necessitate frequent shut-downs for cleaning. Accordingly, apparatus has been developed whereby the pressure within a particular vessel or other environment can be sensed from a location outside of the vessel, without contacting the vessel material with the pressure sensing apparatus, such that when the pressure within the vessel reaches a predetermined value, a switch or other device is automatically actuated. One such device is disclosed in the Little U.S. Pat. No. 3,529,106. Pressure is sensed in accordance with the Little patent by providing an expandable rubber hose connected at one end to the vessel to be controlled, and pinched along a downstream hose segment under a movable lever so that a predetermined amount of pressure within the hose will cause sufficient expansion of the hose segment pinched by the lever to move the lever sufficiently to actuate a switch. The hose of the Little invention can be removed for cleaning, or when replacement is necessary, and the cleaned or new hose is then reinserted under the lever for continued pressure monitoring of the process.

One of the problems that has been found with the apparatus disclosed in the Little U.S. Pat. No. 3,529,106 is that "spring-back" of the initially round hose decreases in proportion to the amount of time that the hose is held under compression by the lever. "Spring-back", as used herein, is the capability of a resilient material to return to, or approach the shape of its initially uncompressed cross section, along the tube length compressed, when substantially all of the compressive forces are removed from the resilient material along the cross-sectional area examined. The apparatus disclosed in the Little U.S. Pat. No. 3,529,106 causes internal stresses within the hose material along the hose length compressed by the lever and these stresses increase with time. Accordingly, as the hose used in operation of the Little invention continues to be compressed by the lever, the "spring-back" of the hose is decreased with time so that the longer a particular hose is used, progressively greater pressure is needed within the hose to move the lever the distance required to actuate the switch. Accordingly, the longer a particular hose is used in accordance with the Little invention the less accurate is the pressure control of a particular vessel.

Another problem found with the apparatus disclosed in the Little patent is that when a particular hose is removed for cleaning, it is impossible to relocate the hose in the same rotational position with respect to the lever. Thus, the "spring-back" will be greater than before hose removal, when the hose is reinserted, causing further inaccuracies and inconsistencies in the pressure control of the vessel.

Other pressure actuable devices are disclosed in the Starbuck U.S. Pat. No. 3,423,551; Aksu U.S. Pat. No. 3,456,086; Spielbauer U.S. Pat. No. 3,569,649; and Possell U.S. Pat. No. 3,636,289.

SUMMARY OF THE INVENTION

The present invention overcomes the above mentioned problems inherent in the operation of the apparatus disclosed in the Little U.S. Pat. No. 3,529,106 by providing a substantially flat resilient tube portion along a tube segment disposed in position between a tube support surface and a movable lever arm so that when the flattened segment expands, a given device is actuated consistently at substantially the same predetermined pressure condition. It has been found that a preflattened tube will retain substantially the same "spring-back" regardless of the amount of time that the tube is compressed by the lever arm during use of the apparatus of the present invention. Further, when the resilient tube of the present invention is removed from the apparatus, as for cleaning, and reinserted, the tube can be reinserted in a substantially identical rotational alignment with respect to the lever arm to achieve actuation of a given device at substantially the same predetermined pressure condition after tube reinsertion as before tube removal.

An object of the present invention is to provide new and improved apparatus capable of actuating a mechanical or electrical device in response to a predetermined pressure condition in a selected environment.

Another object of the present invention is to provide a pressure operated device for providing an output signal in response to a predetermined pressure condition.

Another object of the present invention is to provide apparatus wherein a lever arm is moved in an unexpectedly consistent precise manner in response to a predetermined pressure condition in a given, monitored environment.

Another object of the present invention is to provide a method and apparatus for controlling the actuation of a desired device consistently, precisely and accurately at a predetermined pressure condition in a selected environment, such as a closed vessel or the like, by disposing a tube in fluid communication with said selected environment, said tube having a flattened, deformable tube segment inserted between a tube segment support surface and a moveable tube segment compression member, such that expansion of the tube segment in response to increased pressure within the tube segment causes actuation of the device precisely and consistently at the predetermined pressure condition.

BRIEF DESCRIPTION OF THE DRAWINGS

The above and other objects and advantages of the present invention will become apparent from the following detailed description taken in conjunction with the drawing, in which.

DETAILED DESCRIPTION OF THE PREFERRED EMBODIMENT

Figure 1:
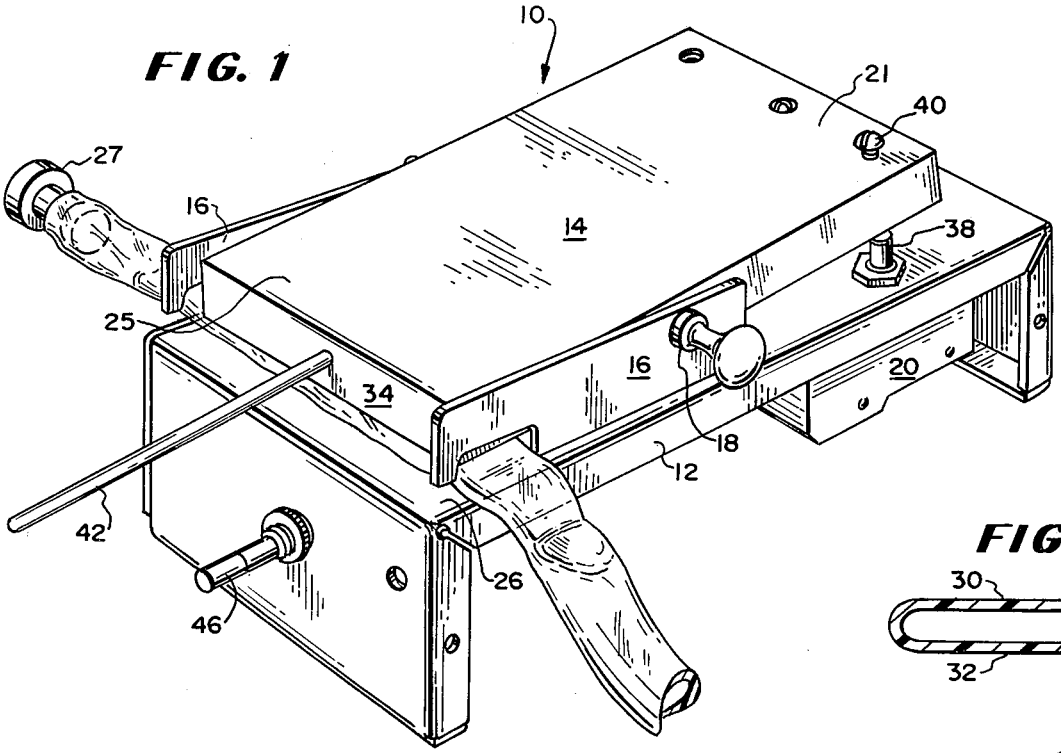
FIG. 1 is a perspective view of the new and improved apparatus of the present invention.

Turning now to the drawing, and initially to FIG. 1 there is illustrated new and improved apparatus, generally designated by reference numeral 10, constructed in accordance with the principles of the present invention for operating a given device when a monitored environment reaches a predetermined pressure condition. In brief, the apparatus of the present invention includes a housing 12; a movable lever 14 supported on the housing 12 through fulcrum support brackets 16; and a fulcrum 18 for the movable lever 14. In a preferred embodiment, a switch 20 is actuable by movement of an arm 21 of lever 14 in response to a predetermined pressure condition within tube 22. One end of the tube 22 is in fluid communication with a pressure monitored vessel (not shown) and a flattened segment 24 of tube 22 is inserted under a lever arm 25 of the lever 14 to position the flattened tube segment 24 between lever arm 25 and a tube support surface 26 of housing 12. The tube 22 can be closed at one end with a cap 27, or the flattened tube can be a fluid transporting conduit forming part of the process. The lever arm 25 is adjustably spring biased toward the tube support surface 26 by coil spring 28 disposed between the housing and lever arm 21.

Figure 2:
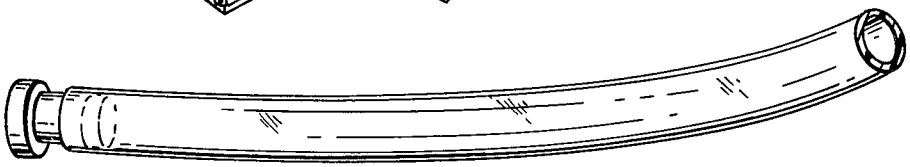
FIG. 2 PRIOR ART
FIG. 2 is a cut-away, elevational view of a tube forming part of the apparatus of prior art devices.

The resilient tube 22 of the present invention is manufactured from any resilient material having physical properties necessary to transport a desired material therethrough without tube deterioration or material contamination. Suitable elastomeric materials are readily available, for example suitable synthetic rubber or rubberlike materials or other polymeric elastomers, such as polyethylene, polypropylene, neoprene or TYGON tubing. TYGON tubing is a readily available tubing material formed from polymeric diene derivatives compounded to produce synthetic rubberlike tubing. The flattened segment 24 of resilient tube 12 can be formed in a number of ways. In accordance with one important embodiment of the present invention, flattened segment 24 is formed by heating the tube segment 24 to a temperature of at least the softening temperature of the tube material and applying pressure to opposed sides of the tube segment 24 with opposing flat dies or pressure plates while the segment is at the softening temperature. The segment can be hot-pressed with opposing heated dies (not shown) to soften the segment 24 of tube 12 and the flattened tube segment then cooled to a temperature below its softening temperature to permanently deform the segment 24 into the flattened shape shown in FIG. 3. Alternatively, the tube 12 can be manufactured by initially forming the tube in the shape shown in FIG. 3. It is preferred to obtain a tube having a round cross-section over its entire length such as shown of the prior art tube of FIG. 2 and heat-flatten segment 24 over a desired length, as described above, since such tubes are readily available and easily are flattened, as described.

Figure 4:
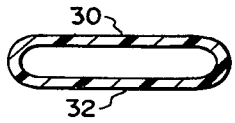
FIG. 4 is a cross-sectional view of the tube segment of the present invention taken through the line 4—4 of FIG. 3.
Figure 3:
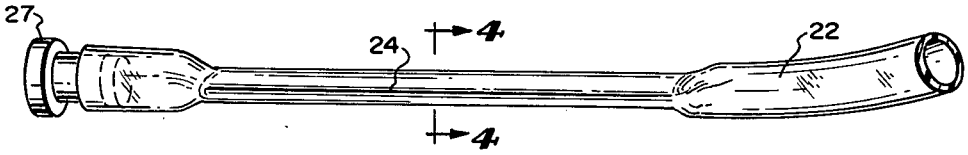
FIG. 3 is a cut-away, elevational view of the flattened tube forming part of the apparatus of the present invention.
Figure 6:
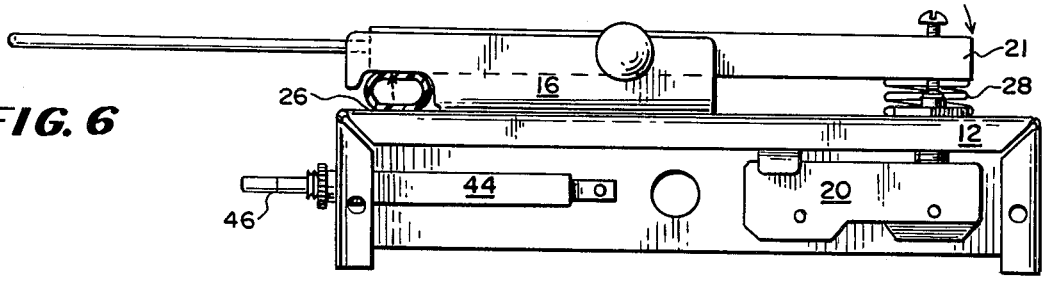
FIG. 6 is a side elevational view of the apparatus of the present invention showing the shape of the tube segment portion of the apparatus when the pressure within the tube segment is sufficient for switch actuation.

To achieve the full advantage of the present invention, two opposing sides 30 and 32 of flattened tube segment 24 are flattened to provide a substantially flat tube segment 24 as best shown in FIGS. 3 and 4. It has been found that the substantially flat tube segment 24 does not accumulate internal stresses as the segment 24 is positioned between tube support surface 26 and lever arm 25 over long periods of time. Further, after the tube has been removed, as for cleaning, and reinserted, the flat tube segment 24 easily can be reinserted in the exact same rotational position with respect to the lever 14, as before removal. These features of flat tube segment 24 provide for new and unexpected accurate and consistent movement of lever 14 when resilient tube 12 is pressurized, as shown in FIG. 6. Alternatively, one surface of tube 12 can be flattened to achieve accurate reinsertion of the tube by disposing the flat side against tube support surface 26 and to achieve more accurate and consistent pressure response results than with prior art tubes (FIG. 2) having a substantially round cross section, but in this alternative embodiment, some of the above-described "spring-back" inconsistencies will remain as the tube continues to be compressed with time.

Figure 5:
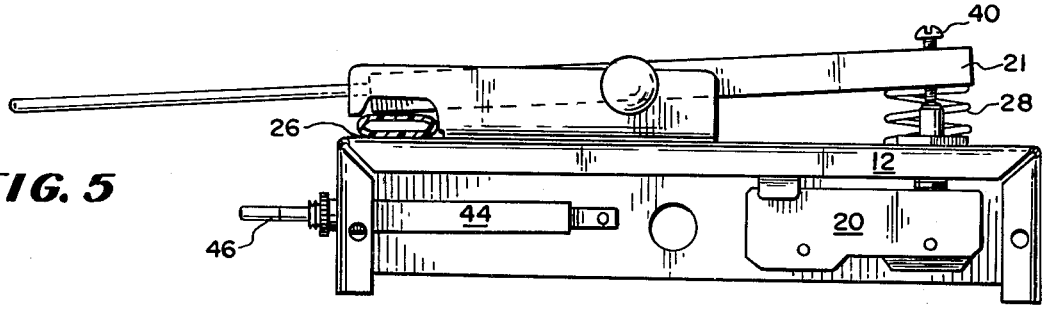
FIG. 5 is a side elevational view of the apparatus of the present invention showing the shape of the tube segment portion of the apparatus prior to the tube being pressurized.

The flattened tube segment 24 is inserted between the lever arm 25 of lever 14 and the tube support surface 26 of housing 12, as shown in FIGS. 1 and 5. The lever arm 25 is adjustably spring biased to lightly contact the tube segment 24 and, in accordance with an important embodiment of the present invention, the lever arm 25 only slightly contacts an upper flattened tube surface 30 so that there is substantially no change in the cross sectional shape of the flattened tube segment 24 when the segment 24 is positioned between the tube support surface 26 and the lever arm 25. The tube segment 24, therefore, will not develop internal stresses with use since the tube segment is only slightly pinched between the support surface 26 and lever arm 25 without substantially changing the uncompressed cross-sectional shape of tube segment 24. The flattened tube segment 24, therefore, always has substantially the same cross sectional shape when inserted between the lever arm 25 and tube support surface 26 before the tube is pressurized, thereby providing new and unexpected consistency in moving lever 14 in response to a given pressure condition within tube 12.

The desired amount of movement of lever arm 25 and corresponding device-actuating movement of lever arm 21 in response to a given pressure wihin tube 12 can be adjusted initially by providing different lengths to lever arm 25 (defined as the length of lever 14 disposed between the lever fulcrum 18 and tube contacting end 34 of lever 14), or by providing coil spring 28 with a desired force for biasing lever arm 25 against the upper surface 30 of flattened tube segment 24.

A switch 20, or other device, can be disposed sufficiently close to the actuating lever arm 21 of lever 14 so that at a predetermined pressure condition, the flattened tube segment 24 will expand, causing the lever arm 21 to contact a closely disposed switch plunger 38 and thereby actuate the switch 20.

The lever 14 is finely calibrated to cause switch 20 to be actuated exactly at a predetermined pressure condition by adjusting an adjustable lever arm extension member 40 closer or farther from plunger 38 of switch 20. Lever arm extension member 40 is a common bolt or screw threaded through lever arm 21 of lever 14 and is disposed in a position to contact plunger 38 in response to a predetermined pressure condition in tube 12. The lever 14 can be provided with an extension handle 42 for manual movement of lever 14 so that the tube segment 24 can be released for cleaning and reinserted. The switch 20 includes an electrically connected manual On-Off switch 44 with manually actuable plunger 46 provided as an override to the function of the pressure-responsive apparatus of the present invention.

In accordance with a specific embodiment of the present invention, the switch 20 is operatively connected to a pump (not shown) which pumps a given fluid into a vessel being pressure monitored. When the pressure condition within the vessel reaches a predetermined maximum, i.e. 6 p.s.i.g., the tube segment has expanded sufficiently to actuate switch 20 thereby turning off the pump. At a predetermined minimum pressure condition, i.e. 3 p.s.i.g., the lever arm 21 is in a position so that the plunger 38 reverses the switch 20 to actuate the pump until the maximum predetermined pressure is reached again.

Although the present invention has been described with reference to several embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. Apparatus in fluid communication with a selected environment of varying pressure, said apparatus responsive to a predetermined pressure change in said environment and causing a controlled, consistent relative movement between a flat tube support surface of said apparatus and a tube compression member of said apparatus comprising:

a tube having a segment of deformable material adapted to expand and contract in response to a varying pressure condition, said tube disposed in fluid communication with said environment and inserted between a flat tube support surface and the tube compression member;

said tube support surface in juxtaposition to said tube compression member, said tube support surface contacting a surface of said tube segment; and said tube compression member contacting another elongated surface of said tube segment in an unpressurized condition so that there is relative movement between said support surface and said tube compression member upon expansion or contraction of said segment of said tube lying between said support surface and said tube compression member;

said tube segment lying between said support surface and said tube compression member being flat on at least said entire elongated surface of said tube segment in contact with the tube compression member when said tube is in an unpressurized condition.

2. Apparatus as defined in claim 1 wherein said flat tube segment is substantially closed in an unpressurized state between the tube compression member and the tube support surface.

3. Apparatus as defined in claim 1 further including a switch disposed near said tube compression member such that a predetermined movement of said tube compression member in response to a predetermined pressure condition in said environment actuates said switch.

4. Apparatus as defined in claim 3 wherein said switch operates a material pump and said material pump delivers said material into or out of a selected environment thereby changing the pressure condition within said environment.

5. Apparatus as defined in claim 4 wherein said flat tube segment is formed by heating said tube segment to a temperature of at least the softening temerature of said material while flattening said tube material between opposing dies while at said temperature and cooling the tube material to a temperature below the softening temperature while said segment is flattened.

6. A pressure operated device for providing an output signal in response to a predetermined pressure condition, said device comprising:

a tube having a segment of deformable material adapted to communicate with a source of varying pressure;

housing means;

a switch supported by the housing means;

said housing means defining a supporting surface for said tube;

a movable member supported by said housing means;

means releasably retaining said tube segment between said supporting surface and said movable member;

said movable member being coupled to said switch for operating the switch to provide an output signal in response to tube segment deformation resulting from the predetermined pressure condition;

and the improvement characterized by;

said tube segment lying between said supporting surface and said movable member being flat on at least an entire elongated surface of said tube segment in contact with said movable member when said tube is in an unpressurized condition.

7. A device as defined in claim 6 wherein portions of said tube spaced from said segment are generally circular in cross section.

8. A device as defined in claim 7 wherein said retaining means defines a tube segment receiving path, the path generally corresponding in shape to said flat tube segment.

9. A device as defined in claim 8 wherein said path has a width smaller than a diameter of the circular cross section of said spaced tube portions.

10. Apparatus as defined in claim 6 wherein said tube segment is substantially closed in an unpressurized condition when inserted within said retaining means.

* * * * *